United States Patent [19]

Inouye et al.

[11] 4,202,595

[45] May 13, 1980

[54] ELECTRICAL CONNECTOR

[75] Inventors: Hiromasa Inouye, Musashino; Tomonari Otsuki; Tsukasa Saito, both of Tokyo, all of Japan

[73] Assignee: Bunker Ramo Corporation, Oak Brook, Ill.

[21] Appl. No.: 914,597

[22] Filed: Jun. 12, 1978

[30] Foreign Application Priority Data

Jun. 14, 1977 [JP] Japan ..... 52-76677

[51] Int. Cl.[2] ..... H01R 13/36

[52] U.S. Cl. ..... 339/174; 339/176 MF; 339/196 A

[58] Field of Search ..... 339/74, 75, 95, 98, 339/99, 196, 200, 273, 274, 174, 176

[56] References Cited

U.S. PATENT DOCUMENTS

| | | | |
|---|---|---|---|
| 2,787,772 | 4/1957 | Liaci | 339/196 A |
| 2,848,705 | 8/1958 | Williams et al. | 339/200 R |
| 3,179,916 | 4/1965 | Larson | 339/174 |
| 3,434,093 | 3/1969 | Wedekind | 339/99 R |
| 3,808,582 | 4/1974 | Aldridge et al. | 339/99 R |

OTHER PUBLICATIONS

IBM Tech. Disclosure Bulletin, vol. 17, No. 1, pp. 138, 139, Jun. 1974.

*Primary Examiner*—Neil Abrams

*Attorney, Agent, or Firm*—F. M. Arbuckle; John R. Hoffman

[57] ABSTRACT

An electrical connector for removable connection with a plurality of spaced conductors in a flat strip, such as a length of ribbon wire. The connector includes a housing containing a plurality of contacts and a conductor supporting member movable relative to the housing between an insertion position and a clamping position. The contacts and the conductors supporting the member define a plurality of conductor-receiving passages, the passages becoming smaller in size when the supporting member is moved from the insertion position to the clamping position. The conductors of a flat strip may be easily inserted into the passageways when the supporting member is in the insertion position, and the conductors are securely clamped between the contacts and the supporting member when the supporting member is in the clamping position.

8 Claims, 11 Drawing Figures

Fig. 1
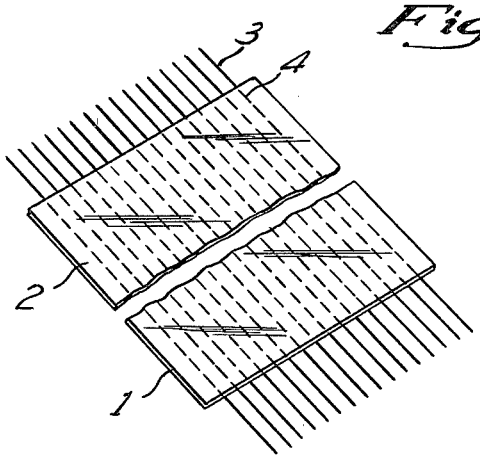
Fig. 2
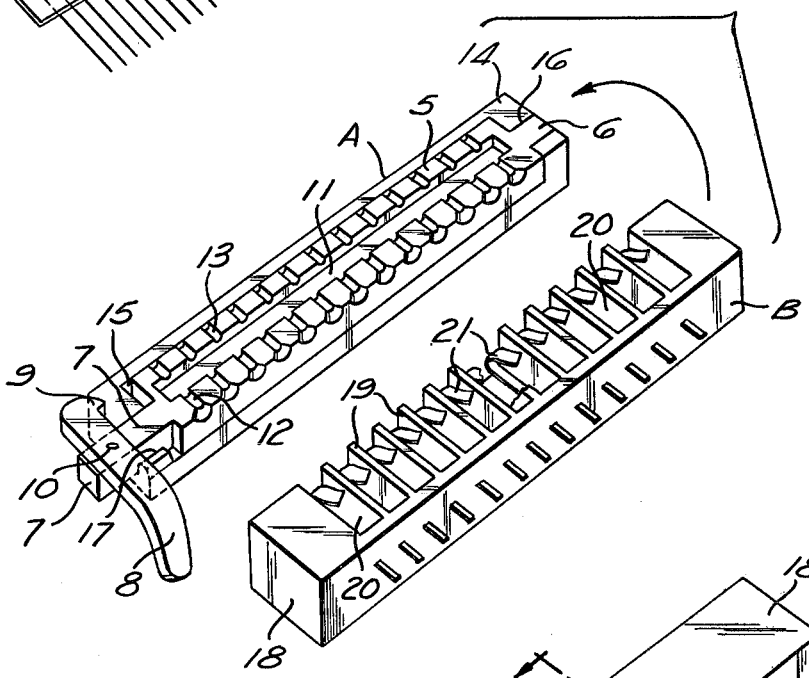
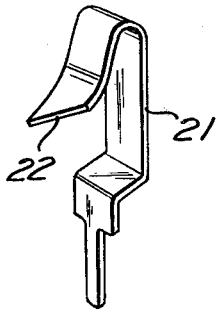
Fig. 3
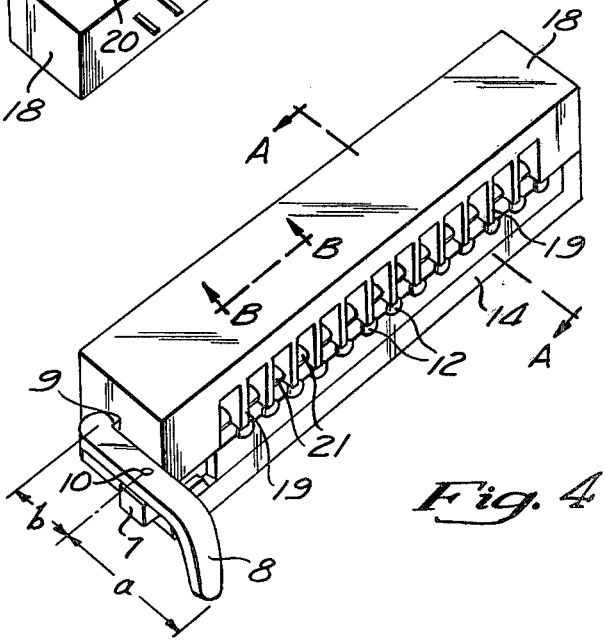
Fig. 4

Fig. 5
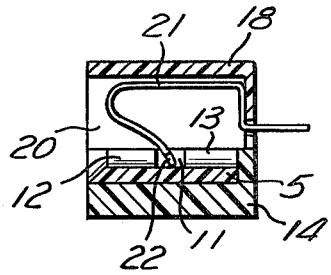
Fig. 7
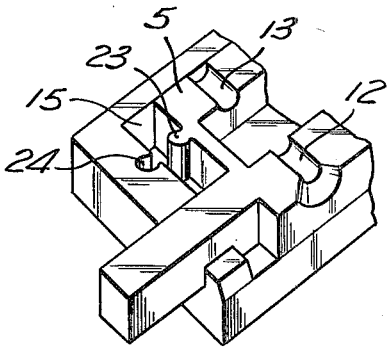
Fig. 6A
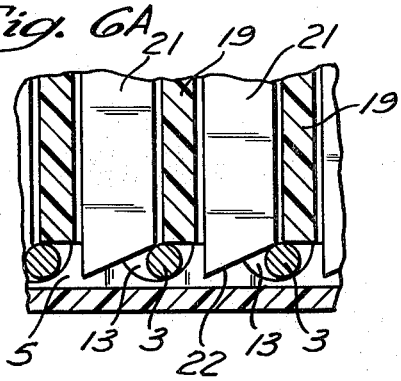
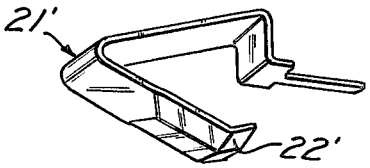
Fig. 8A
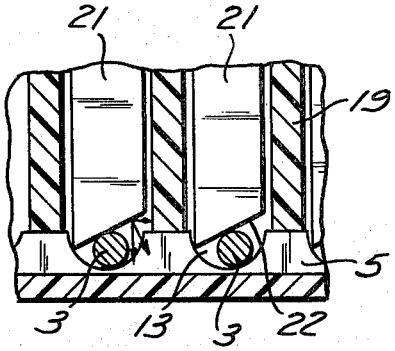
Fig. 6B
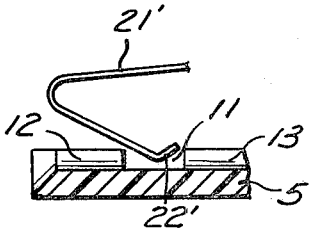
Fig. 8B
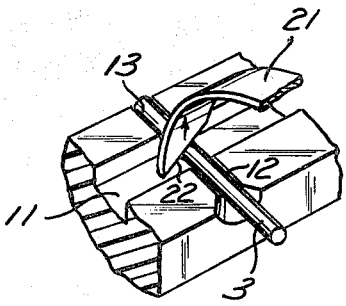
Fig. 6C

ELECTRICAL CONNECTOR

TECHNICAL FIELD

The present invention relates to the field of electrical connectors and, in particular, to the field of connectors for removable connection with a plurality of spaced conductors in a flat strip.

BACKGROUND OF PRIOR ART

Miniaturized electronics, in particular computer systems, require the connection of various sub-assemblies with a plurality of separate conductors. Such connections are commonly made with ribbon wire, that is, a plurality of individual conductors spaced apart and sandwiched between two layers of insulating material. The sub-assemblies to be connected are often printed circuit boards, and it is advantageous to be able to break the connection between the wire and the circuit boards, either to service the circuit boards or to effect changes in the interconnection wiring.

Connection of ribbon wire to the sub-assemblies has presented considerable difficulties, since the individual conductors of the ribbon wire are extremely flexible and delicate. Accordingly, the common prior art practice for connecting ribbon wire to circuit boards is to separately solder each conductor to the circuit board. This process is extremely time consuming and therefore very expensive. Automated techniques for soldering printed circuit boards including dipping the circuit boards in hot baths of solder have been found to be inappropriate for use with ribbon wire due to its high flexibility and the tendency of the conductors to disconnect themselves from the circuit boards during the soldering process.

The various connectors are available for permanent connection to the ends of ribbon wire, but these connectors require individual connection of each of the conductors to a separate contact element of the connector. Accordingly, this process is as time consuming as soldering the conductors to the circuit boards.

Connectors for rigid circuit boards are well known in the art, and usually include a housing having a printed circuit board receiving channel therein. A plurality of resilient contact elements are located in the channel, so that each contact engages a respective contact area of the circuit board when the circuit board is inserted into the channel.

Such connectors are ill-suited for use with flexible flat wire, since the conductors of the wire are not rigid enough to displace the resilient contact members of the connector to allow insertion of the conductors. If the resiliency of the contact elements is reduced to allow insertion, dependability of the resulting connection is greatly reduced, due to the reduction of contact pressure.

BRIEF SUMMARY OF INVENTION

It is therefore an object of the present invention to provide a connector for removable connection with the conductors of a flat strip such as a length of ribbon wire, which provides a dependable electrical connection.

It is a further object of the present invention to provide a connector in which the force required to insert the conductors into the connector is relatively minimal, whereas the contact pressure between the contact elements and the conductors is relatively high.

It is a still further object of the present invention to provide an electrical connector having a movable conductor supporting member which, when in an insertion position allows easy insertion of the conductors into the connector and, when in a clamping position, causes a relatively large contact pressure between the conductors and the contact elements.

The electrical connector of the present invention includes a housing, a plurality of contact elements in the housing, and a conductor supporting member movable relative to the housing between the insertion position and a clamping position. The contact elements and the conductor supporting member are arranged to define a plurality of conductor receiving passageways. Each of these passageways is wider when the conductor supporting member is in the insertion position than when the conductor supporting member is in the clamping position. Accordingly, the conductors of a length of ribbon wire or the like can easily be inserted into the conductor receiving passageways when the conductor supporting member is in the insertion position, but a significant contact pressure is applied between the contact members and the conductors when the conductor supporting member is in the clamping position.

In a preferred embodiment of the present invention, the individual contact elements are partially enclosed in respective contact chambers of the housing. Additionally, the preferred form of the contact members includes a resilient contact portion having a beveled end adjacent the conductor supporting member. The conductor supporting member preferably includes a plurality of parallel grooves extending in a direction perpendicular to its direction of movement, the grooves defining at least a portion of the conductor receiving passageways. As the conductor supporting member is moved, the conductors contained in the passageways (grooves) are moved along with the conductor supporting member. When in the insertion position, each of the grooves of the conductor supporting member is adjacent a first portion of the beveled surface of respective ones of the contact elements, and as the conductor supporting member is moved towards the clamping position, the parallel grooves, and therefore the conductors, are moved relative to the beveled surface of the contact elements to a point at which the beveled surfaces securely engage respective ones of the conductors.

A further elongated groove may be provided in the conductor supporting member which extends in a direction parallel to the direction of movement of the conductor supporting member and is aligned with the beveled surfaces of the contact members. The bottom of this groove provides a flat surface for movement along the beveled surfaces of the contact members.

In order to assure easy movement of the conductor supporting member, an arm may be coupled to the member providing a mechanical advantage. Additionally, a latch assembly may be provided for releasably securing the conductor supporting member in the clamping position.

The invention will now be described in detail with reference to the accompanying drawings representing the preferred embodiments of the electrical connector of the present invention.

BRIEF DESCRIPTION OF DRAWINGS

FIG. 1 is a perspective view of a length of ribbon wire;

FIG. 2 is a partially exploded perspective view of the connector of the present invention;

FIG. 3 is a perspective view of a contact member of the connector of FIG. 2;

FIG. 4 is a perspective view of the connector in the assembled condition;

FIG. 5 is a cross-sectional view taken along line AA of FIG. 4;

FIG. 6A is a cross-sectional view taken along line BB of FIG. 4, with the conductor supporting member in the insertion position;

FIG. 6B is a cross-sectional view similar to FIG. 6A, but with the conductor supporting member in the clamping position;

FIG. 6C is a detail view of a portion of the conductor supporting member and one of the contact elements securing a conductor;

FIG. 7 is a perspective view of a portion of an alternate embodiment of the connector showing the optional latching assembly;

FIG. 8A is a perspective view of an alternate embodiment of a contact member for use with the connector of FIG. 2;

FIG. 8B is a perspective view of a portion of a connector according to the present invention and employing the contact element of FIG. 8A.

DETAILED DESCRIPTION OF INVENTION

As shown in FIG. 1, a common length of ribbon wire includes upper and lower insulating layers 1 and 2, enclosing conductors 3. The conductors 3 are held apart by the insulating layers 1 and 2 as shown at 4.

FIG. 2 shows the two parts A and B of the connector in a disassembled condition. In order to assemble the connector, the part B is inverted and placed on top of the part A, as indicated by the curved arrow in the figure. The two parts may be secured together by any conventional means, such as by the use of screws or glue.

Conductor supporting member 5 includes axially extending guiding tabs 6 and 7. In order to facilitate movement of the conductor supporting member, operating arm 8 may be attached to tab 7, such that movement of the free end of the arm causes the arm to pivot about its fixed end 9, causing movement of the tab 7 by means of pivotal connection 10.

In a preferred embodiment, conductor supporting member 5 includes a generally rectangular groove 11 extending in a direction parallel to the direction of movement of the member 5. The groove 11 forms a flat backing surface for the conductors which are inserted in conductor receiving grooves 12 and 13. The grooves 12 and 13 are sized to easily accept the conductors 3 of the ribbon wire and are normally semi-circular in cross section. In order to facilitate insertion of the conductors, the front end of the grooves 12 may include a tapering guide portion for directing the ends of the conductors into the grooves 12.

Housing 14 includes a large cavity 15 for slidably receiving the conductor supporting member 5. The cavity 15 is slightly longer than the conductor supporting member 5, in order to allow movement of the supporting member 5 between a clamping position and an insertion position Slots 16 and 17 communicate with the cavity 15 and allow movement of the guiding tabs 6 and 7, respectively, of the conductor supporting member 5.

Upper housing 18 is sized to mate with housing 14, and may include a plurality of dividers 19 forming a plurality of contact receiving chambers 20. Contacts 21 are securely mounted in the chambers 20 and preferably include a resilient portion positioned adjacent the groove 11 of the conductor supporting member 5 and a terminal portion extending outwardly from the housing 18.

As shown in FIG. 3, the contact 21 includes a beveled surface 22 at an end of its resilient portion.

FIG. 4 shows the connector in an assembled condition with upper housing 18 mated with lower housing 14.

Actuating arm 8 is preferably formed to provide a mechanical advantage by a predetermined positioning of the pivot point 10. Since a force applied at the free end of the arm 8 has an effective lever arm of a, and since the force applied to the case 18 through the end 9 of the arm 8 has an effective lever arm of b, the mechanical advantage provided by the arm 8 is equal to a/b. Experiments have shown that a typical connector according to the present invention requires a force of 300 grams to move the conductor supporting member 5 into a clamping position. Clearly, the force required at the free end of arm 8 to effect such movement can be reduced to any desired level by proper design of the arm 8.

The cross-sectional view of FIG. 5 shows the relationship of the beveled end 22 of the contact member 21 to the groove 11 of conductor supporting member 5. Additionally, it can be seen that the groove 11 effectively bisects the conductor receiving passageway formed by the grooves 12 and 13.

When the conductor receiving member 5 is in the insertion position, (as shown in FIG. 6A) the conductor receiving grooves 12 and 13 are aligned with the shorter end of the beveled surface 22 of the contact elements 21. Accordingly, the conductor receiving passageways formed by the grooves 12 and 13 are relatively large and allow easy insertion of the conductors 3.

When the conductor supporting member 5 subsequently moves toward the clamping position (see FIG. 6B), the grooves 12 and 13, together with the conductors 3, are moved along the beveled surface 22 of the contact element 21 toward the longer end of the beveled surface thereby decreasing the effective size of the conductor receiving passageways. As this movement occurs, the resilient portion of the contact element 21 is compressed, and it exerts a force on the conductors 3 in a direction normal to the beveled surface. As shown in FIG. 6B, this force can be resolved into the sum of two forces, one acting parallel to and against the movement of the conductor supporting member 5, and the other acting perpendicular to the movement and compressing the conductor 3 against the lower wall of the groove 11 (see FIG. 6C). As the conductor supporting member 5 is moved further, the resilient portion of the contact element 21 is forced away from the member 5 in the direction of the arrow in FIG. 6C. As a result of the resiliency of the contact member, the force exerted on the conductor 3 is increased. Since the beveled surface 22 slides along the conductor 3, the conductor is "wiped" removing any oxidation or surface coatings from the conductors and the contact element, thereby assuring a good electrical connection.

Although the frictional forces between the conductor supporting member 5 and the housing 14 are usually sufficient to prevent unwanted movement of the conductor supporting member, the particular design of the connector and the angle of the beveled surface 22 may make it desirable to include a latch assembly to hold the conductor supporting member 5 in the clamping position.

A preferred embodiment of the latching assembly is shown in FIG. 7 and comprises a projecting finger 23 attached to conductor supporting member 5, and a matingly shaped recess 24 in housing 14. The projecting finger and the recess are shaped such that the finger and the walls of the recess are resiliently deformed upon insertion of the finger 23 into the recess 24, thereby latching the member in the clamping position. Naturally, the latching assembly could be formed in a number of different ways, depending upon the particular design of the connector and the amount of latching force desired.

While the beveled surface of the contact element shown in FIG. 3 is an end surface of the flat material forming the element 21, it is also possible to form a beveled surface 22′ on the side of the contact member, such as the contact member 21′ shown in FIG. 8A. FIG. 8B shows a cross-sectional view similar to FIG. 5, but with the alternate contact element 21′. As shown in FIG. 8B, beveled surface 22′ aligns with groove 11 and functions in a manner identical to beveled surface 22 of contact element 21.

Both of the disclosed contact elements include a projecting terminal to allow connection of the contact elements with a printed circuit board or the like. Naturally, the terminal ends could as easily be formed as part of a conventional printed circuit board connector to allow removable connection of the connector with a rigid printed circuit board.

Additionally, while only a single row of conductor receiving grooves 12 and contact elements 21 have been described, it is possible to form a connector having parallel rows of grooves 12 and 13 on opposite sides of a conductor supporting element 5, with contact elements adjacent both sides thereof, thereby allowing insertion of twice as many conductors in a given length connector.

From the foregoing, it should be readily realized that this invention can assume various embodiments. Thus, it is to be understood that the invention is not limited to the specific embodiments described herein, but is to be limited only by the appended claims.

We claim:

1. An electrical connector for removable connection with a plurality of spaced conductors in a flat strip, said connector comprising: housing means; a plurality of contact means in said housing means, said contact means each including a resilient contact portion which has a beveled surface; and conductor supporting means movable relative to said housing means between an insertion position in which spaced conductors are to be located onto said conductor supporting means and a clamping position in which said spaced conductors are forced against said beveled surfaces of said contact means, said contact means and said conductor supporting means defining a plurality of conductor receiving passageways, with said beveled surfaces of said plurality of contact means being disposed in said passageways for varying the width of said passageways and for exerting resilient forces against said conductors, said passageways extending generally perpendicular to the direction of said relative movement between said conductor supporting means and said housing means and perpendicular to a plane passing through the beveled surfaces of said contact means, whereby said relative movement of said supporting means from said insertion position to said clamping position decreases the size of each of said passageways and thereby increases the resilient forces between said conductors and the beveled surfaces of said contact means.

2. The connector as claimed in claim 1, wherein said housing means includes a plurality of contact chambers partially enclosing said contact means.

3. The connector as claimed in claim 1, wherein each of said contact means includes a terminal portion extending outwardly from said housing means.

4. The connector as claimed in claim 1, wherein said conductor supporting means includes a groove extending parallel to said direction of movement and being aligned with said beveled surfaces of said contact means, said further groove bisecting each of said passageways.

5. The connector as claimed in claim 1, wherein each of said beveled surfaces is an end surface of said contact means.

6. The connector as claimed in claim 1, further comprising actuating arm means coupled to said conductor supporting means for causing movement thereof.

7. The connector as claimed in claim 1, further comprising latch means for releasably securing said conductor supporting means in said clamping position.

8. The connector as claimed in claim 1, wherein said relative movement between said conductor supporting means and said housing means is effective to move said conductors between two predetermined areas of said beveled surfaces.

* * * * *